US005627559A

United States Patent [19]

Tsuboyama et al.

[11] Patent Number: 5,627,559

[45] Date of Patent: May 6, 1997

[54] ELECTROOPTICAL DISPLAY APPARATUS AND DRIVER

[75] Inventors: Akira Tsuboyama; Kazunori Katakura, both of Atsugi, Japan

[73] Assignee: Canon Kabushiki Kaisha, Tokyo, Japan

[21] Appl. No.: 384,451

[22] Filed: Feb. 3, 1995

Related U.S. Application Data

[63] Continuation of Ser. No. 968,494, Oct. 29, 1992, abandoned.

[30] Foreign Application Priority Data

Oct. 31, 1991 [JP] Japan ..... 3-311496

[51] Int. Cl.[6] ..... G09G 3/36

[52] U.S. Cl. ..... 345/97; 345/87; 345/94

[58] Field of Search ..... 345/97, 55, 68, 345/76, 87, 90, 94, 99, 100, 103

[56] References Cited

U.S. PATENT DOCUMENTS

| | | | |
|---|---|---|---|
| 4,412,214 | 10/1983 | Tanaka et al. | 345/52 |
| 4,625,204 | 11/1986 | Clerc | 340/784 |
| 4,962,376 | 10/1990 | Inoue et al. | 340/784 |
| 4,990,902 | 2/1991 | Zenda | 345/132 |
| 5,010,327 | 4/1991 | Wakita et al. | 340/784 |
| 5,093,737 | 3/1992 | Kanbe et al. | 345/97 |
| 5,095,377 | 3/1992 | Kobayashi et al. | 345/97 |

*Primary Examiner*—Mark R. Powell
*Assistant Examiner*—Matthew Luu
*Attorney, Agent, or Firm*—Fitzpatrick, Cella, Harper & Scinto

[57] ABSTRACT

In an electrooptical display apparatus for displaying a desired image on an optical modulation medium filled in a gap between scan electrodes and information electrodes by applying electrical signals to the electrodes, when the optical modulation medium has memory characteristics for preserving an image even in a drive waveform non-application state after the image is formed by a proper drive operation, non-display area scan electrodes and non-display area information electrodes for driving non-display areas (32, 33, 34) are arranged on the non-display areas outside a display unit (31) of an electrooptical element (3) constituted by the optical modulation medium and the scan and information electrodes so as to extend parallel to the scan and information electrodes, respectively, and a non-display area driver (22) for forming desired uniform non-display areas by applying a pulse drive signal to the non-display area scan electrodes at a predetermined interval asynchronously with scanning of the display unit is arranged.

16 Claims, 3 Drawing Sheets

ELECTROOPTICAL DISPLAY APPARATUS AND DRIVER

This application is a continuation of application Ser. No. 07/968,494 filed Oct. 29, 1992, now abandoned.

BACKGROUND OF THE INVENTION

1. Field of the Invention

The present invention relates to an electrooptical display apparatus using an electrooptical element driven by an electrical signal and having memory characteristics and an electrooptical element driver used in the display apparatus and, more particularly, to a drive method for a non-display area outside an image forming area on the electrooptical element.

2. Related Background Art

Upon application of an electric field equal to or higher than a threshold value, an electrooptical medium having memory characteristics undergoes a desired switching operation, and thereafter, when the electric field is turned off or when an electric field below the threshold value is applied, the state after switching can be held. Since the medium having such characteristics can store information by the effect of its memory characteristics after the desired switching operation is performed by a write signal, it can be applied to, e.g., a large-capacity display element.

As a typical electrooptical medium having memory characteristics, a ferroelectric liquid crystal is known. The ferroelectric liquid crystal (FLC) is sealed between substrates subjected to a proper orientation treatment to prepare a cell having a liquid crystal layer which is thin enough to eliminate the spiral structure, thus providing two stable states having memory characteristics.

Such a liquid crystal cell can identify the two stable states to dark and bright states using at least one polarizer by utilizing birefringence of the liquid crystal. The switching operation between the two states is controlled by an electrical signal applied through electrodes formed by appropriately patterning the above-mentioned substrates.

In such a liquid crystal cell, in general, stripe-like scan electrodes are formed on one substrate, and stripe-like information electrodes are formed on the other electrode. Bright and dark states are written in pixels formed at crossing portions of the electrodes according to combinations of scan signals and information signals applied to these electrodes. In this manner, the liquid crystal cell is utilized as a display element.

When the electrooptical medium having memory characteristics such as an FLC is used as the display element, the following problems are posed.

More specifically, the display element is housed in a chassis or a casing to attain functions and safety, to protect an element electrical system, and to assure good outer appearance. In some cases, the display surface is concealed by the thickness of the chassis or the casing when it is viewed from an oblique direction. In order to avoid such cases, a non-display area is arranged around a display area, so that an effective display area can be prevented from being concealed unless it is watched from an angle outside a predetermined range.

However, with this arrangement, when such a non-display area is formed in a medium such as an FLC having memory characteristics, since the FLC is in an arbitrary state before an electrical signal exceeding a threshold value is applied to the FLC, the non-display area is not under control, and a display becomes nonuniform, thus considerably deteriorating the outer appearance in a practical use. Therefore, the non-display area must be controlled to a uniform state by an electrical signal. In this case, the memory characteristics need only satisfy image quality and a display function of the display element, and are not permanent. Therefore, a drive signal must be periodically applied.

Thus, the following technique is conventionally proposed. That is, electrodes for driving a non-display area are arranged around a display area, and an electrical signal is applied to the electrodes to drive a liquid crystal of the non-display area so as to realize a uniform display area (e.g., Japanese Laid-Open Patent Application No. 63-243994).

In the technique described in Japanese Laid-Open Patent Application No. 63-243994, however, as will be described later with reference to FIG. 3, since the non-display area is driven while interrupting a line scan operation of the display area after the line scan operation of the display area, the scan time is prolonged as compared to a case wherein only the display area is scanned, and the frame frequency of the display area is undesirably decreased.

SUMMARY OF THE INVENTION

It is an object of the present invention to provide a drive signal application method capable of driving a non-display area without decreasing the frame frequency of a display area as compared to a case wherein only the display area is scanned.

In order to achieve the above object, according to the present invention, there is provided an electrooptical display apparatus, which comprises an electrooptical element comprising scan electrodes and information electrodes, which are arranged to oppose each other through a gap, and an optical modulation medium filled in the gap, and drive means for displaying a desired image on the optical modulation medium by applying electrical signals to the electrodes, wherein the optical modulation medium has memory characteristics for preserving an image even in a drive waveform non-application state after the image is formed by a proper drive operation, the electrooptical element has an arrangement in which non-display area scan electrodes and non-display area information electrodes for driving a non-display area are arranged on the non-display area outside an image forming area to respectively extend parallel to the scan electrodes and the information electrodes, and the drive means comprises non-display area drive means for forming a desired uniform non-display area by applying, to the non-display area scan electrodes, a pulse drive signal at a predetermined interval asynchronously with scanning of a display area.

DETAILED DESCRIPTION OF THE PREFERRED EMBODIMENT

In the preferred embodiment of the present invention, the optical modulation medium comprises a ferroelectric liquid crystal having two stable states. The non-display area drive means applies pulses having a width and voltage sufficient for setting all the pixels formed on the non-display area scan electrodes in a desired stable state as a drive signal to the non-display area scan electrodes independently of the state of an application signal to information electrodes for driving the display area.

Note that the drive means itself is effective as a driver for the electrooptical element.

According to the present invention, the non-display area drive means applies a pulse drive signal having a predetermined period (1 Hz to 100 Hz, and preferably, 5 Hz to 20 Hz) as sufficiently large AC pulses exceeding a threshold voltage (AC pulses having a voltage average of 0 are preferable) to the non-display area scan electrodes so as to form a desired uniform non-display area.

Therefore, the display area can be driven by the same drive signal as a conventional drive signal for scanning only the display area. For this reason, the frame frequency of the display area is not adversely affected.

The present invention will be described in more detail below with reference to the accompanying drawings.

Figure 1:
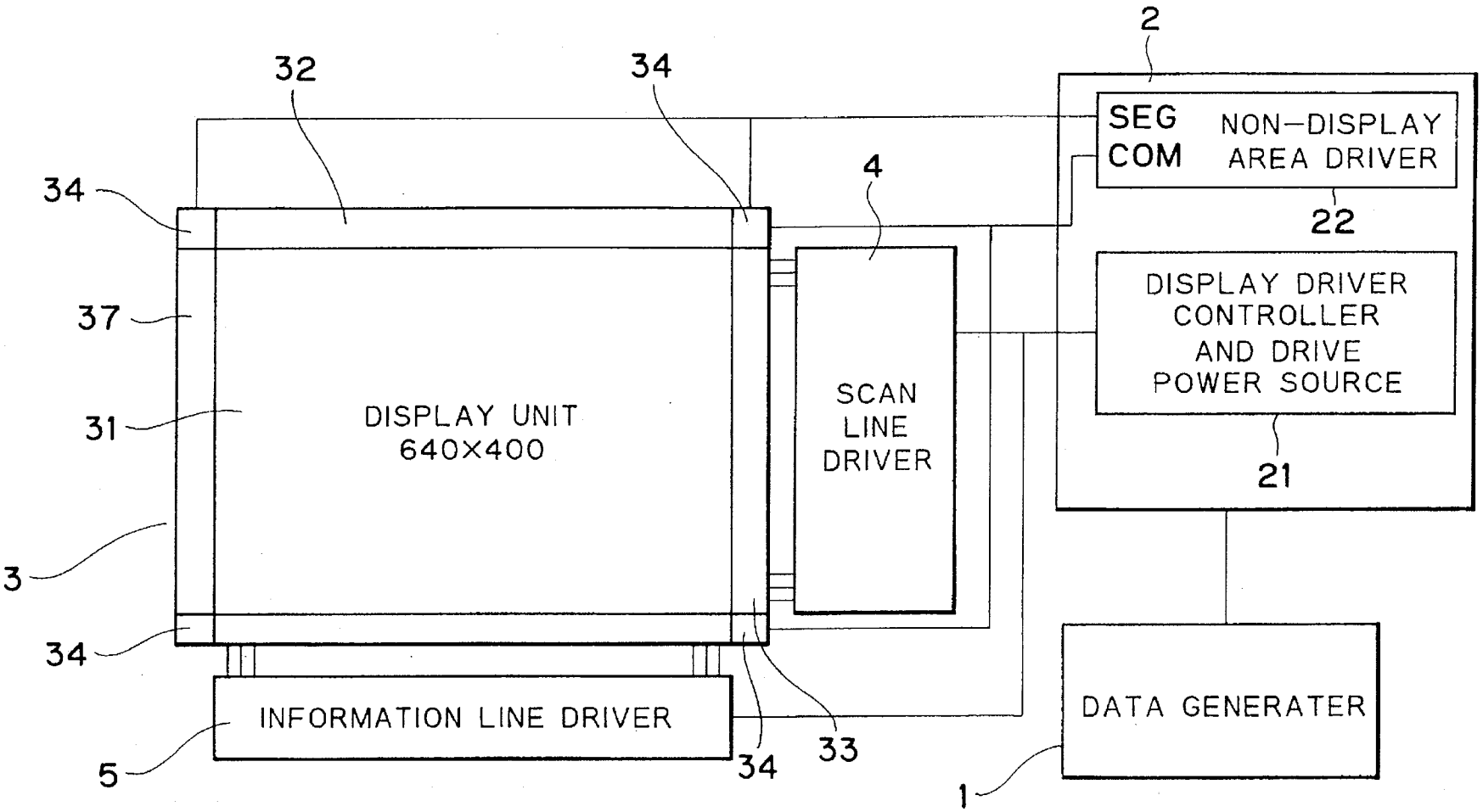
FIG. 1 is a block diagram of a display system according to an embodiment of the present invention.

FIG. 1 is a block diagram of a display system according to an embodiment of the present invention. The display system shown in FIG. 1 includes a data generator 1 for generating display data, a display controller 2, a ferroelectric liquid crystal (FLC) display element 3, a scan line driver 4, and an information line driver 5.

The FLC display element 3 has a 640×400 dot display unit 31. More specifically, 640 scan electrodes and 400 information electrodes are formed for a display. Non-display areas 32, 33, and 34 are formed around the display unit 31, and the above-mentioned scan and information electrodes extend to the non-display areas 33 and 34. Twenty three non-display area scan electrodes having the same length as that of the scan electrodes, and extending parallel to them are formed on each of the non-display areas 32 and 34 at the two sides of the scan electrodes, and 46 non-display area information electrodes extending parallel to the information electrodes are formed on each of the non-display areas 33 and 34 at the two sides of the information electrodes. The end portions of the non-display area scan electrodes are commonly connected to each other, so that these electrodes can be simultaneously driven by a single scan signal. The end portions of the non-display area information electrodes are similarly commonly connected to each other.

The display controller 2 comprises a display driver, controller and drive power source 21, and a non-display area driver 22. The display driver, controller and drive power source 21 has the same arrangement as that of a conventional display controller for driving only the display unit, and generates display image data and pixel address data according to display data supplied from the data generator 1.

Figure 2:
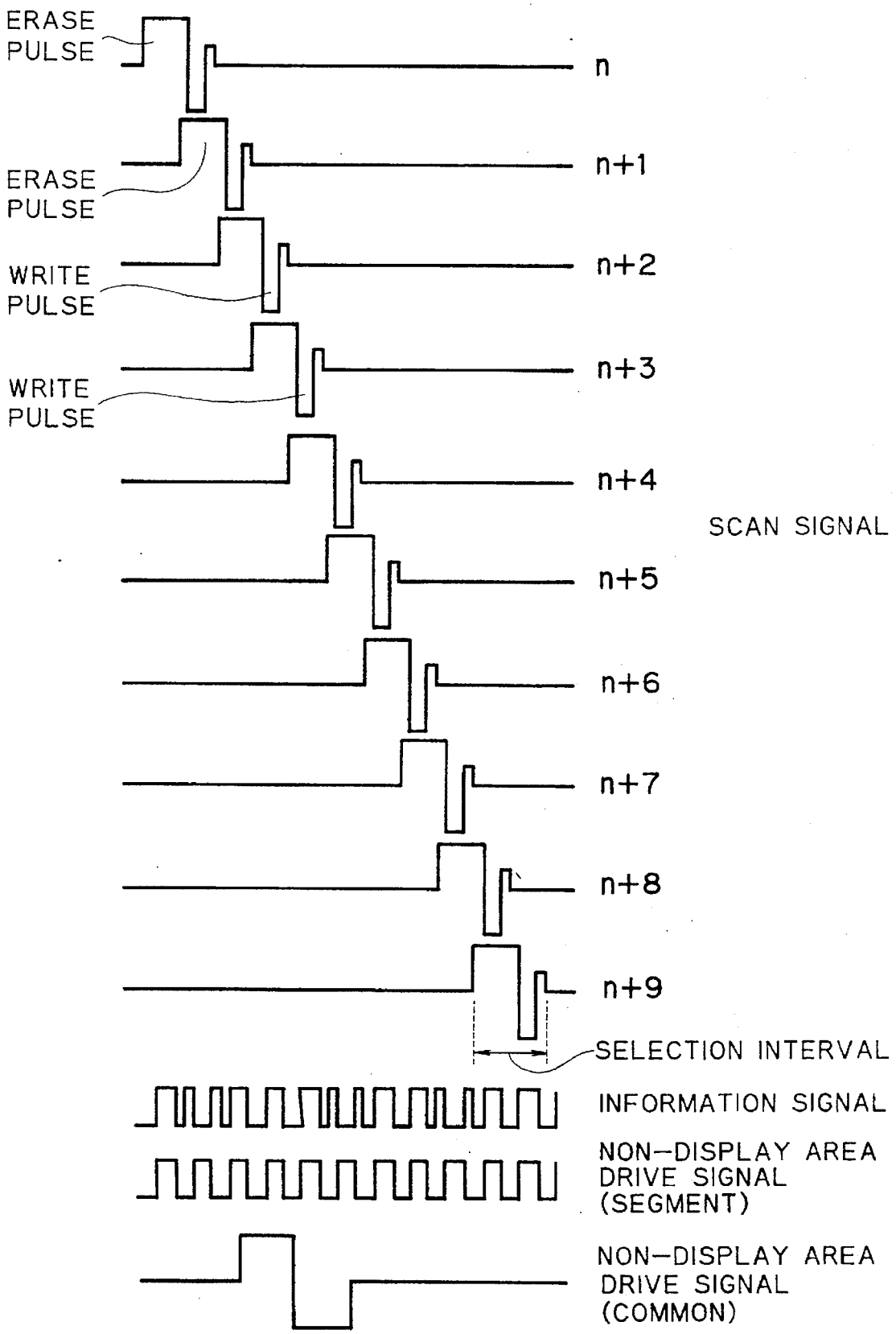
FIG. 2 is a waveform chart showing non-display and display area drive waveforms in the system shown in FIG. 1.

The scan line driver 4 generates scan signals shown in FIG. 2 on the basis of the pixel address data, and the information line driver 5 generates information signals (see FIG. 2) on the basis of the display image data in synchronism with the scan signals.

The scan and information electrodes of the FLC display element 3 are respectively driven by the scan and information line drivers 4 and 5, and an image according to the display data is displayed on the display unit 31.

The non-display area driver 22 of the display controller 2 generates non-display area drive signals (segment and common drive signals) shown in FIG. 2 asynchronously with the display image data, and the like, and outputs these signals from a segment terminal SEG and a common terminal COM, respectively. These non-display area drive signals are applied to the non-display area scan and information electrodes which are commonly connected in the FLC display element 3.

FIG. 2 is an explanatory view of some scan signals to be applied to the scan electrodes and some information signals to be applied to the information electrodes in the system shown in FIG. 1. As can be seen from a scan signal waveform during a selection interval of each scan line (scan electrode), all the pixels on the scan line are erased by an erase pulse of the positive electric field side, and thereafter, pixels are written by a write pulse of the negative electric field side. The write pulse is synchronous with the information signal, and when a composite waveform of these signals exceeds a write threshold value, an erase state transits to the other state; otherwise, the erase state is held. In this manner, the two states are selectively written during the selection interval, and this operation is repeated for all the scan lines, thereby forming a desired image.

The drive signals for controlling the non-display areas arranged around the display unit in a uniform state will be described below.

The waveform of the non-display area drive signal (segment signal) to be applied to the non-display area information electrodes arranged parallel to the segment lines (information electrodes) is the same as a bright state write signal waveform of the display area information signal, and a bright state is attained by a composite waveform of the non-display area drive signal and the scan signal in accordance with the same principle as that for the display unit.

Figure 3:
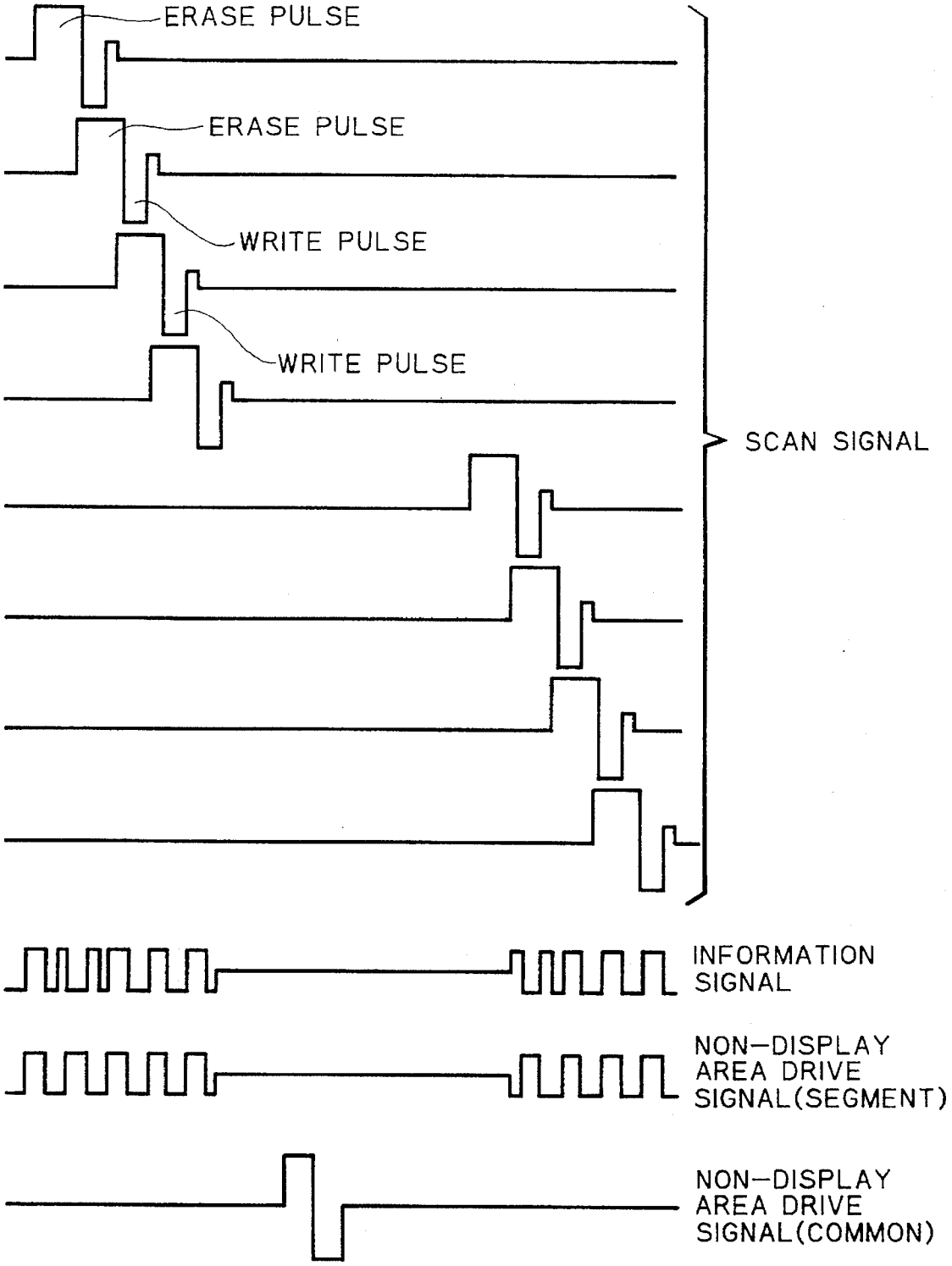
FIG. 3 is a waveform chart showing conventional non-display and display area drive waveforms.

On the other hand, the non-display area drive signal (common signal) to be applied to the non-display area scan electrodes arranged parallel to the scan lines has a waveform different from that of the scan lines of the display unit, and the waveform need only have a sufficiently large pulse width and voltage so as to set the non-display area in a bright state even during an application of the information signals for driving the display unit. FIG. 3 shows an example of the waveform of this non-display area drive signal. With this signal, pixels formed by the non-display area scan electrodes, and non-display area and display area information electrodes on the non-display areas 32 and 34 are forcibly written with a bright state by the non-display area drive signal (common signal) independently of the state of the corresponding drive signal. Pixels formed by the non-display area information electrodes and display area scan electrodes on the non-display area 33 are written with a bright state by the scan signals and the non-display area drive signal (segment signal).

According to the characteristic feature of the present invention, since the write operation for the non-display areas is performed by applying a signal to the non-display areas parallel to the scan lines even during scanning of the scan lines of the display unit, one frame updating interval (frame interval) of a display on the display unit is not disturbed.

FIG. 3 is presented as a comparative example for the embodiment, and is the same explanatory view as FIG. 2 for explaining the drive method described in Japanese Laid-Open Patent Application No. 63-243994.

The method described in this patent application drives the non-display areas while interrupting scanning of the display unit after a line write operation. Such a method of controlling the non-display areas by applying a signal to the non-display areas parallel to the scan lines while interrupting scanning of the display unit is not preferable since the frame frequency of the display unit is undesirably decreased.

What is claimed is:

1. A display apparatus comprising:

a display panel comprising an image information display section having N scanning electrodes arranged side by side, and M information electrodes crossing said N scanning electrodes, and an image information non-display section having additional electrodes arranged at an outside of and along said N scanning electrodes; and driving means having means for supplying a scanning signal to a selected scanning electrode, while supplying a predetermined voltage to another of said scanning electrodes that is non-selected, means for supplying an information signal to said M information electrodes synchronously with the scanning signal, and means for applying a non-display section drive signal to said additional electrodes during only a predetermined time period and for applying a predetermined voltage in a period other than the predetermined period, wherein said additional electrodes are supplied with the non-display section driving signal, to set said non-display section at a predetermined optical state, during the period of supplying the scanning signal to any of said N scanning electrodes.

2. A display apparatus according to claim 1, wherein said display panel comprises a liquid crystal disposed between said scanning electrodes and said information electrodes.

3. A display apparatus according to claim 1, wherein said display panel has a memory function.

4. A display apparatus according to claim 1, wherein said display panel comprises a ferroelectric liquid crystal sandwiched between said scanning electrodes and said information electrodes.

5. A display apparatus according to any of claims 2–4, wherein said driving means supplies, as the scanning signal, a pulse sequence including an erasing pulse of a first polarity and a writing pulse of a second polarity, the writing pulse being applied subsequent to the erasing pulse.

6. A display apparatus according to any of claims 1 or 2–4, wherein said driving means supplies, as the non-display section drive signal, a sequence of pulses including a first pulse of a first polarity and a second pulse of a second polarity, the second pulse being applied subsequent to the first pulse.

7. A display apparatus according to any of claims 1 or 2–4, wherein said driving means supplies, as the non-display section drive signal, a pulse which sets an optical state of said image information non-display section at a light state independent of the information signal.

8. A display apparatus according to any of claims 1 or 2–4, wherein said driving means supplies the non-display section drive signal at a frequency of 1–100 Hz.

9. A display apparatus according to any of claims 1 or 2–4, wherein said image information non-display section is provided at four sides of a periphery of said image information display section.

10. A display apparatus according to any of claims 1 or 2–4, wherein the scanning electrodes are parallel to each other and form a group defining said image information display section, and wherein one of said additional electrodes is provided in parallel with the scanning electrodes and on either side of the group thereof, so that said image information non-display section is provided at four sides of said image information display section.

11. A display apparatus comprising:

a liquid crystal display panel comprising:

an image information displaying section having N scanning electrodes arranged side by side and M information electrodes crossing said N scanning electrodes, and an image information non-displaying section having additional electrodes arranged at an outside of and along said N scanning electrodes; and a driver for supplying a scanning signal to a selected scanning electrode, for supplying a predetermined voltage to a non-selected scanning electrode, for supplying an information signal to said M information electrodes synchronously with the scanning signal, for supplying a non-display signal to said additional electrodes during a predetermined period, and for supplying a predetermined voltage to said additional electrodes during a period other than the predetermined period, wherein said additional electrodes are supplied with the non-display section driving signal, to set said non-display section at a predetermined optical state, during the period of supplying the scanning signal to any of said N scanning electrodes.

12. A display apparatus according to claim 11, wherein said liquid crystal panel has a memory function, and wherein said driver supplies, as the scanning signal, a pulse sequence including an erasing pulse of a first polarity and a write pulse of second polarity, said write pulse being applied subsequent to the erasing pulse.

13. A driver for a display panel comprising M information electrodes and N scanning electrodes crossing the information electrodes and arranged side by side to constitute an image information display section and additional electrodes, arranged outside of and along the N scanning electrodes, to constitute a non-display section, said driver comprising:

a first driver for supplying a scanning signal to a selected scanning electrode, and for supplying predetermined voltage to a non-selected scanning electrode; and a second driver for supplying an information signal to the M information electrodes synchronously with the scanning signal, wherein said first driver supplies a non-display section drive signal, during a predetermined time period, to the additional electrodes, and supplies a predetermined voltage to the additional electrodes during a period other than the predetermined time period, and the additional electrodes are supplied with the non-display section drive signal, to set the non-display section at a predetermined optical state, during a period of supplying the scanning signal to any of the N scanning electrodes.

14. A driver according to claim 13, wherein the scanning signal is a pulse sequence including an erasing pulse of a first polarity and a write pulse of a second polarity, and wherein the non-display section drive signal is a pulse sequence including a pulse of a first polarity and a pulse of a second polarity.

15. A driver control apparatus for display panel comprising M information electrodes and N scanning electrodes arranged side by side and crossing said M information electrodes to constitute an image information display section, and additional electrodes arranged outside of and along the N scanning electrodes to constitute an image information non-display section, said driver control apparatus comprising:

a first driver for supplying a scanning signal to selected scanning electrodes and for supplying predetermined voltage to non-selected scanning electrode; and a second driver for supplying an information signal to the information electrodes synchronously with the scanning signal, wherein said first driver supplies, during a predetermined period, a non-display driving signal to the additional electrodes and supplies, during a period other than the predetermined period, a predetermined voltage to the additional electrodes, and wherein said driver control apparatus supplies the non-display section drive signal to additional electrodes, to control said first driver, so that the non-display section is set at a predetermined optical state, during the period of supplying the scanning signal to any of N scanning electrodes.

16. A driver control apparatus according to claim 15, wherein the scanning signal is a pulse sequence including an erasing pulse of a first polarity and a write pulse of a second polarity, the write pulse being applied subsequent to the erasing pulse, and wherein the non-display driving signal is a pulse sequence including a first pulse of a first polarity, and a second pulse of a second polarity, the second pulse being applied subsequent to the first pulse.

* * * * *

UNITED STATES PATENT AND TRADEMARK OFFICE

CERTIFICATE OF CORRECTION

PATENT NO. : 5,627,559

DATED : May 6, 1997

INVENTOR(S) : AKIRA TSUBOYAMA ET AL.

It is certified that error appears in the above-identified patent and that said Letters Patent is hereby corrected as shown below:

ON TITLE PAGE AT ITEM [56], References Cited

U.S. PATENT DOCUMENTS

Insert:

--4,922,241 5/1990 Inoue et al.
4,728,176 3/1988 Tsuboyama et al.--

FOREIGN PATENT DOCUMENTS

Insert:

--2-172039 7/3/90 Japan
63-243994 10/11/88 Japan
285401 10/5/88 EPO
223309 5/27/87 EPO
387034 9/12/90 EPO--

COLUMN 5

Line 33, "claims 2-4," should read --claims 1 or 2-4--.

Signed and Sealed this

Second Day of December, 1997

*Attest:*

*Attesting Officer*

BRUCE LEHMAN

*Commissioner of Patents and Trademarks*